US005387967A

United States Patent [19]

Brewington et al.

[11] Patent Number: 5,387,967

[45] Date of Patent: Feb. 7, 1995

[54] SINGLE-COMPONENT ELECTROPHOTOGRAPHIC DEVELOPMENT SYSTEM

[75] Inventors: Grace T. Brewington, Fairport; Paul C. Julien, Webster; John F. Knapp, Fairport, all of N.Y.; Masashi Kajimoto, Atugi, Japan; Hidekiyo Tachibana, Ebina, Japan; Kazuo Terao, Ayase, Japan; Yutaka Toyoda, Sagamihara, Japan; Mikio Yamamoto, Chicago, Ill.

[73] Assignee: Xerox Corporation, Stamford, Conn.

[21] Appl. No.: 125,883

[22] Filed: Sep. 23, 1993

[51] Int. Cl.[6] ..... G03G 15/06

[52] U.S. Cl. ..... 355/259; 355/215; 355/245

[58] Field of Search ..... 355/245, 250, 251, 253, 355/259, 215; 118/653, 656, 657

[56] References Cited

U.S. PATENT DOCUMENTS

| | | | |
|---|---|---|---|
| 3,791,730 | 2/1974 | Sullivan, Jr. . | |
| 3,937,570 | 2/1976 | Hudson . | |
| 4,226,524 | 10/1980 | Hashimoto | 118/657 X |
| 4,235,194 | 11/1980 | Wada et al. | 118/657 |
| 4,304,192 | 12/1981 | Mayer | 118/653 |
| 4,707,428 | 11/1987 | Terao et al. | 430/102 |
| 4,792,831 | 12/1988 | Takeda et al. | 355/215 |
| 4,926,217 | 5/1990 | Bares | 355/253 |
| 4,990,958 | 2/1991 | Brewington et al. | 355/245 |
| 5,028,959 | 7/1991 | Gooray | 355/215 |
| 5,063,412 | 11/1991 | Hirsch | 355/259 |
| 5,065,693 | 11/1991 | Yoshino et al. | 118/657 |
| 5,070,812 | 12/1991 | Yamaji | 355/251 X |
| 5,097,295 | 3/1992 | Tanaka | 355/246 |
| 5,128,723 | 7/1992 | Bolte et al. | 355/259 |
| 5,134,960 | 8/1992 | Shirai | 118/653 |
| 5,143,017 | 9/1992 | Haneda et al. | 118/653 X |
| 5,166,733 | 11/1992 | Eliason | 355/251 |
| 5,253,016 | 10/1993 | Behe et al. | 355/215 |
| 5,311,264 | 5/1994 | Kinoshita | 355/259 |
| 5,324,884 | 6/1994 | Honda et al. | 355/259 X |

OTHER PUBLICATIONS

Xerox Disclosure Journal, vol. 16, No. 5 Sep./Oct. 1 *Developer Material Transport* Grace Brewington, William H. Wayman.

*Primary Examiner*—A. T. Grimley
*Assistant Examiner*—Sandra L. Brasé
*Attorney, Agent, or Firm*—R. Hutter

[57] ABSTRACT

An apparatus develops an electrostatic latent image on a charge-retentive surface. A donor roll is selectably rotatable in a process direction and in a reverse direction relative to the process direction. A toner mover loads toner particles onto a portion of the surface of the donor roll. A metering blade is disposed downstream of the toner mover in the process direction. A seal is disposed upstream of the toner mover in the process direction, and is adapted to remove at least approximately half of the undeveloped toner from the donor roll.

4 Claims, 2 Drawing Sheets

SINGLE-COMPONENT ELECTROPHOTOGRAPHIC DEVELOPMENT SYSTEM

This invention relates generally to an electrophotographic printing machine, and more particularly concerns a single component development system.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive surface. After the electrostatic latent image is recorded on the photoconductive surface, the latent image is developed by bringing a developer material into contact therewith. Two component and single component developer materials are commonly used. A typical two component developer material comprises magnetic carrier granules having toner particles adhering triboelectrically thereto. A single component developer material typically comprises toner particles. Toner particles are attracted to the latent image forming a toner powder image on the photoconductive surface. The toner powder image is subsequently transferred to a copy sheet. Finally, the toner powder image is heated to permanently fuse it to the copy sheet in image configuration.

The traditional advantages of single-component development have been a general compactness and lightness of the equipment therein, which is particularly useful for portable or home-office printers and copiers. Although single-component development is well-known as a general concept in electrophotography, any number of practical problems have caused this type of development to be seen as inferior to more sophisticated types of development, especially two-component development. One common copy-quality problem with single-component development is known as "ghosting." Ghosting is a copy quality defect which is caused by the fact that, in extended use, perceptible differences in print density will be caused within single prints, particularly along the width of the process direction of the machine. More specifically, when a number of prints are made with a single-component development device, the areas along the width of the donor roll in which there is a great deal of printing (for example, between the margins when a great number of text documents are printed) will experience a high turnover of toner particles on and off the donor roll as successive images are developed and the donor roll is replenished with toner. In any toner supply there will be a range of toner particle sizes, and larger toner particles have been found to "favor" the portions of the length of the donor roll where there is a high turnover of particles. Larger toner particles tend to create relatively denser, darker images on a print sheet. Thus, when a number of copies or prints are created having a consistent set of margins, a subsequent copy or print with larger margins will provide a noticeably darker print area in the areas of the image within the margins of the original set of documents. The portion of the length of the donor roll which has not been used in a long time will have a heavy statistical bias of smaller toner particles which will create relatively lighter printed areas on the sheet.

Another common copy-quality problem associated with single-component development is streaking. This type of defect is most commonly caused by the presence of agglomerated, or clumped, toner on the donor roll. These clumps cause a nonuniform toner layer on the donor, leading to nonuniform print density. In one single-component design a metering blade is positioned against the donor roll just upstream of the contact point with the photoreceptor, with the intention of ensuring a relatively smooth layer of toner on the donor roll and essentially fencing out these harmful clumps. However, the use of a metering blade by itself has been shown to create other, equally inconvenient problems with the long-term use of the machine. A large amount of agglomerated toner is quickly collected in front of the metering blade by the very action of the metering blade; this large accumulation of clumped toner will itself cause pressure against the metering blade and, among other possible things, cause streaks in the toner layer or push the metering blade up so that the clumps of toner will find their way to the photoreceptor.

The twin evils of ghosting and clumping of toner have in the past created fundamental copy-quality problems with single-component development systems. It is an object of the present invention to provide a single-component development unit wherein a unique combination of elements therein enables high-quality development without the traditional quality problems associated with this type of development.

U.S. Pat. No. 4,926,217 discloses a transport device in which toner particles are fluidized within a duct, and a pressure differential is generated which moves the fluidized toner particles from one end of the duct to the other end.

U.S. Pat. No. 4,990,958 discloses a single-component development system wherein an electrically biased flap of conductive material is in rubbing contact with a toner mover, which in turn loads a layer of toner onto a donor.

U.S. Pat. No. 4,707,428 discloses a development method wherein a toner carrying layer of a certain specific resistance is formed over a development electrode opposite the electrostatic latent image. A fringing field is formed between the toner carrying layer and the electrostatic latent image by means of a high-frequency alternating electric field.

U.S. Pat. No. 5,063,412 discloses a development apparatus which may be shut off as needed within a multicolor printing system when a particular developer unit is shut off, a tubular member which typically moves toner into a development zone, rotates in the opposite direction to the direction of rotation when the developer unit is operative.

U.S. Pat. No. 5,097,295 discloses a developer unit in which excess developer material is prevented from being accumulated on a partition plate. The partition plate is provided with holes for causing the developer material to fall downwardly therethrough. Also, an AC voltage may be applied to the partition plate, or the partition plate may be swung or vibrated, in order to remove the accumulation.

U.S. Pat. No. 5,128,723 discloses a single-component developing unit in which fluidized toner particles are transported from one end of the developer housing to the other end. A rotating rod is urged into contact with the donor roll, and serves to charge and meter the toner on the donor roll. Electrically biased wires in the development zone between the latent image and the donor roll detach toner from the donor roll to form a toner powder cloud.

The article "Developer Material Transport" in the Xerox Disclosure Journal (Vol. 16, No. 5, Sep.-Oct. 1991, p. 317) discloses a developer material transport device in which developer material is fluidized and moves through a developer housing while simultaneously attracted to a donor roll.

According to the present invention, there is provided an apparatus for developing an electrostatic latent image on a charge-retentive surface. A donor roll is selectably rotatable in a process direction and in a reverse direction relative to the process direction. A toner mover loads toner particles onto a portion of the surface of the donor roll. A metering blade is disposed downstream of the toner mover in the process direction. A seal is disposed upstream of the toner mover in the process direction, and is adapted to remove at least approximately half of the toner on the donor roll.

Figure 2:
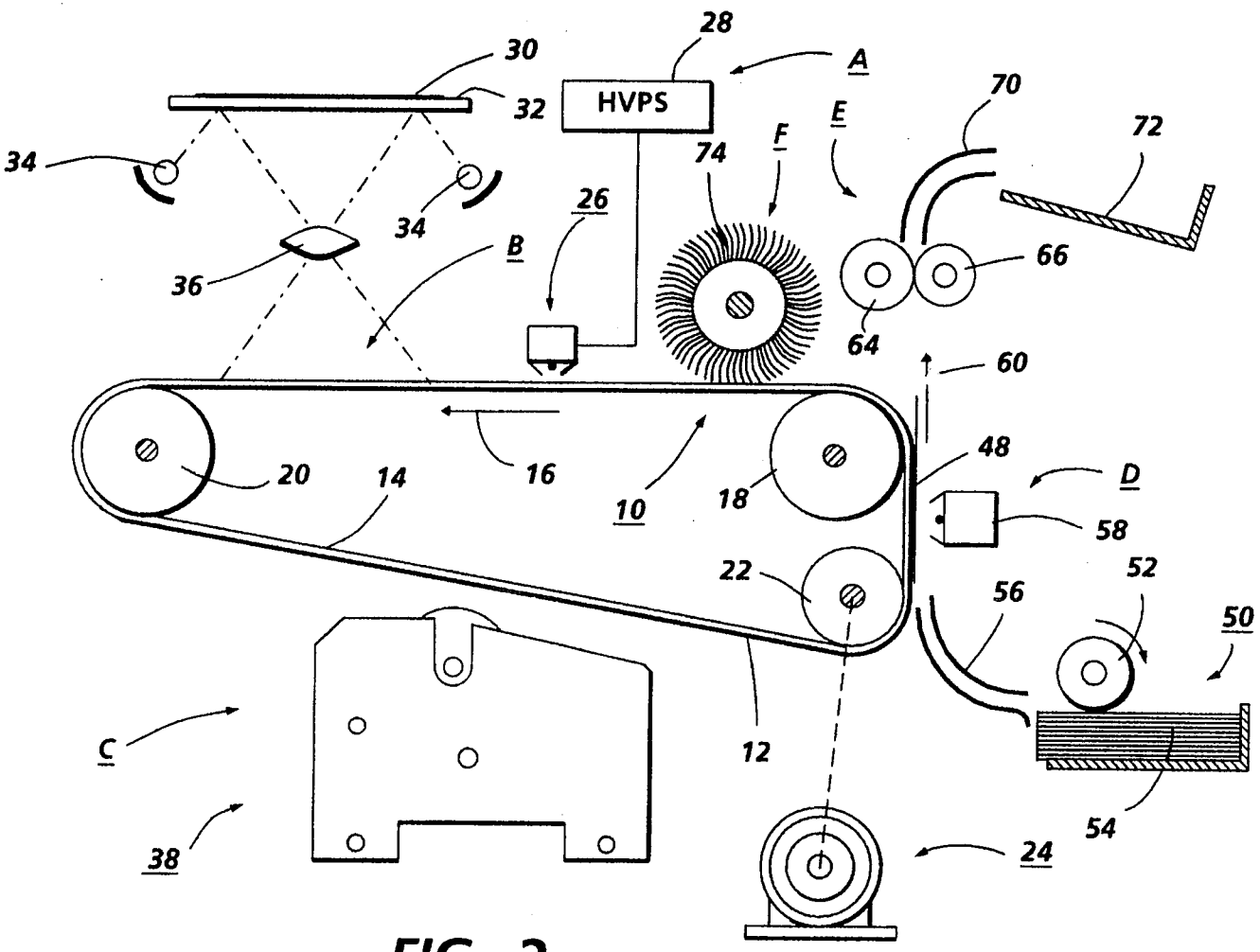
FIG. 2 PRIOR ART
FIG. 2 is an elevational sectional view of an electrophotographic printing machine incorporating the development apparatus of the present invention therein.

Referring initially to FIG. 2, there is shown an illustrative electrophotographic printing machine incorporating the development apparatus of the present invention therein. The electrophotographic printing machine employs a belt 10 having a photoconductive surface 12 deposited on a conductive substrate 14. Preferably, photoconductive surface 12 is made from a selenium alloy. Conductive substrate 14 is made preferably from an aluminum alloy which is electrically grounded. One skilled in the art will appreciate that any suitable photoconductive belt may be used. Belt 10 moves in the direction of arrow 16 to advance successive portions of photoconductive surface 12 sequentially through the various processing stations disposed about the path of movement thereof. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a drive belt. Belt 10 is maintained in tension by a pair of springs (not shown) resiliently urging tensioning roller 20 against belt 10 with the desired spring force. Stripping roller 18 and tensioning roller 20 are mounted to rotate freely.

Initially, a portion of belt 10 passes through charging station A. At charging station A, a corona generating device, indicated generally by the reference numeral 26, charges photoconductive surface 12 to a relatively high, substantially uniform potential. High voltage power supply 28 is coupled to corona generating device 26. Excitation of power supply 28 causes corona generating device 26 to charge photoconductive surface 12 of belt 10. After photoconductive surface 12 of belt 10 is charged, the charged portion thereof is advanced through exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses this light image onto the charged portion of photoconductive surface 12 to selectively dissipate the charge thereon. This records an electrostatic latent image on photoconductive surface 12 which corresponds to the informational areas contained within original document 30.

After the electrostatic latent image has been recorded on photoconductive surface 12, belt 10 advances the latent image to development station C. At development station C, a developer unit, indicated generally by the reference numeral 38, develops the latent image recorded on the photoconductive surface. The development system of the present invention will be described in detail below.

With continued reference to FIG. 2, after the electrostatic latent image is developed, belt 10 advances the toner powder image to transfer station D. A copy sheet 48 is advanced to transfer station D by sheet feeding apparatus 50. Preferably, sheet feeding apparatus 50 includes a feed roll 52 contacting the uppermost sheet of stack 54. Feed roll 52 rotates to advance the uppermost sheet from stack 54 into chute 56. Chute 56 directs the advancing sheet of support material into contact with photoconductive surface 12 of belt 10 in a timed sequence so that the toner powder image developed thereon contacts the advancing sheet at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 onto a conveyor (not shown) which advances sheet 48 to fusing station E.

Fusing station E includes a fuser assembly, indicated generally by the reference numeral 62, which permanently affixes the transferred powder image to sheet 48. Fuser assembly 62 includes a heated fuser roller 64 and a back-up roller 66. Sheet 48 passes between fuser roller 64 and back-up roller 66 with the toner powder image contacting fuser roller 64. In this manner, the toner powder image is permanently affixed to sheet 48. After fusing, sheet 48 advances through chute 70 to catch tray 72 for subsequent removal from the printing machine by the operator.

After the copy sheet is separated from photoconductive surface 12 of belt 10, the residual toner particles adhering to photoconductive surface 12 are removed therefrom at cleaning station F. Cleaning station F includes a rotatably mounted fibrous brush 74 in contact with photoconductive surface 12. The particles are cleaned from photoconductive surface 12 by the rotation of brush 74 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 1:
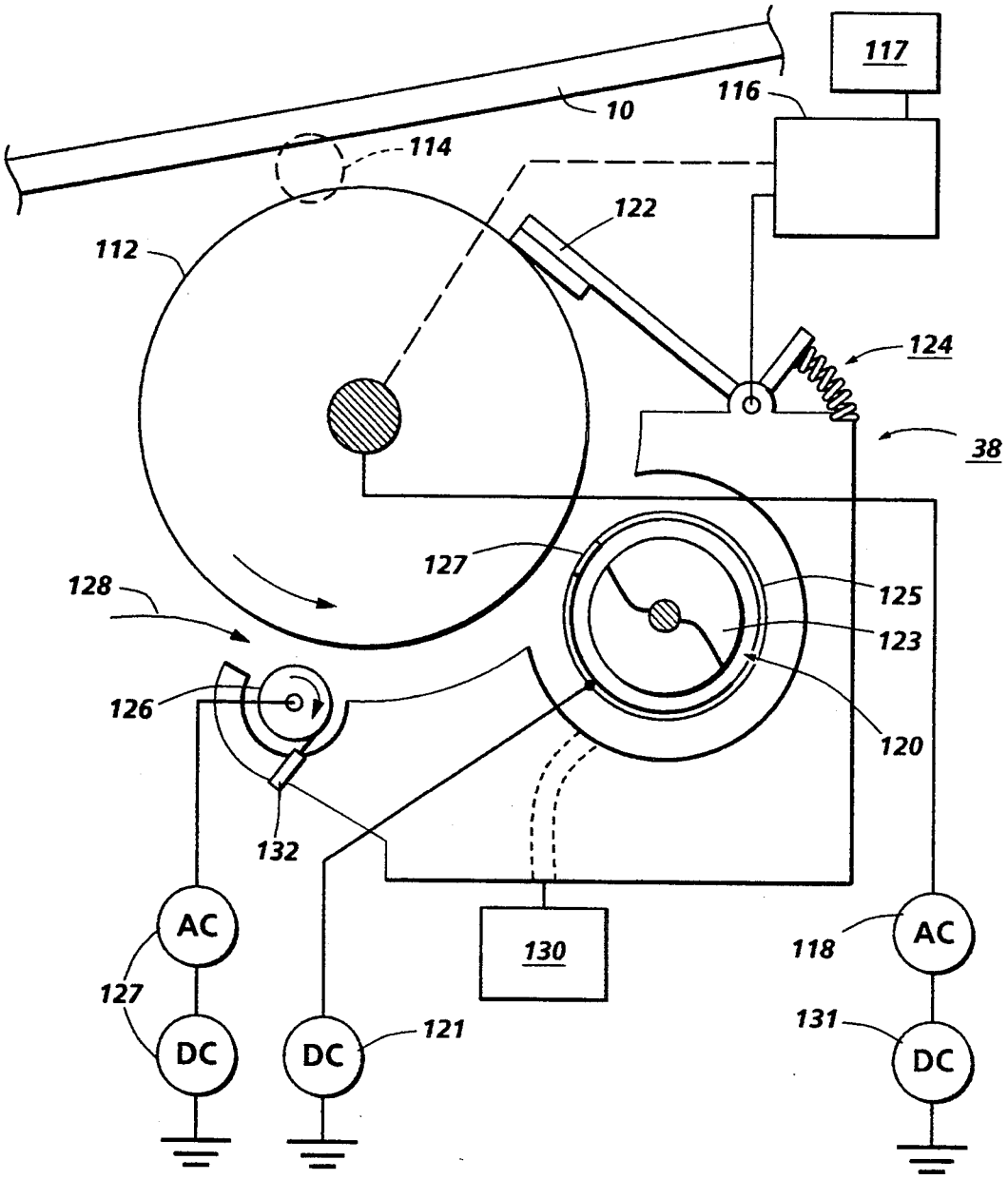
FIG. 1 is an elevational view of a single-component developer apparatus according to the present invention.

FIG. 1 is a simplified sectional, elevational view of a developer unit made according to the present invention. The developer unit, generally indicated as 38, is disposed in the development portion along the process path of the photoreceptor 10. Spaced adjacent to, but not in contact with, a portion of the photoreceptor 10 is a portion of the donor roll 112. The surface of donor roll 112 preferably comprises phenolic plastic. The nip between the photoreceptor 10 and the donor roll 112 is indicated as development zone 114. Donor roll 112 is caused to move in the direction shown by the arrow by a control motor schematically indicated as 116. The direction of motion of the donor roll 112 may be with or against the direction of the photoreceptor 10, depending on the design of the apparatus. Further, the donor roll 112 is itself provided with an AC bias as shown by the AC source 118, relative to the photoreceptor conductive surface 12. This AC bias between the donor roll 112 and photoreceptor conductive surface 12 creates the desired AC fields within the development zone 114, by which "AC jumping" development is enabled. The outer surface at least of donor roll 112 is preferably of a phenolic plastic of a predetermined resistivity. The resistivity of the surface of donor roll 112 will, as is well known, be coordinated with the frequency and amplitude of the fields to yield the most efficient possible development. The donor roll is provided with a DC bias relative to the photoreceptor conductive surface 12 by the DC source 131. This DC bias controls the amount of toner developed onto the latent image.

Turning now to the lower portion of the donor roll 112 as shown in FIG. 1, there is shown a toner mover indicated as 120. One suitable type of toner mover is described in U.S. Pat. No. 5,128,723, assigned to the assignee hereof, which is incorporated herein by reference. The toner mover described in this patent fluidizes the toner therein and causes new toner to be continuously entered into the toner mover. The force on the fluidized toner from the entering new toner causes the toner to be moved continuously through the toner mover. Another type of particle transport which may be used for toner mover 120 is disclosed in U.S. Pat. No. 4,926,217, assigned to the assignee hereof and incorporated by reference herein. In this type of toner mover, an external source of positive or negative pressure, such as a blower, is used to move the fluidized toner through the toner mover. There is provided within the toner mover an elongated agitator which fluidizes or agitates the toner particles, although the agitator described in the patent does not provide direct longitudinal movement through the toner mover. Yet another type of toner mover, which is generally illustrated in FIG. 1, includes an auger 123 disposed within a hollow tube 125 extending along the length of the donor roll 112. This hollow tube 125 may have defined therein a plurality of openings, such as 127, on the side thereof, through which toner particles are extruded to be accessed by the donor roll 112. For present purposes, the key feature of the toner mover 120 is that it is able to convey toner particles throughout the length (going into the page in the view of FIG. 1) of the donor roll 112. In any of these above cases, there is typically provided one or more slots or openings in the side of the toner mover 120 so that extruded toner particles may be made available on the outer surface of the toner over for transfer as needed to the donor roll 112.

Whatever the specific structure of the toner mover 120, fluidized toner particles are transported from one end of this toner mover 120 while simultaneously an electrical bias is applied between the toner mover 120 and the donor roll (by, for example, DC source 121) so as to attract toner from the toner mover to the donor roll 112. The purpose of biasing the toner mover 120 is to electrostatically load right sign toner onto the donor roll 112. Workable biases of the toner mover referenced to the donor would be −200 to −1500 volts with the preferred range being −500 to −1000 volts (for negative toner). The non-contacting toner mover applies a relatively thick layer of toner to the donor roll 112. The layer applied by the toner mover 120 is sufficiently thick to ensure an adequate supply to smooth out any voids in the toner layer already on the donor roll 112.

It will also be apparent that, instead of using a relative electrical bias between the toner mover 120 and the donor roll 112, a magnetic-based system could be used in conjunction with magnetic toner, for example by providing a stationary assembly of permanent magnets within a rotatable sleeve forming the outer surface of donor roll 112.

Further "downstream" of the toner mover 120 along the path of rotation of donor roll 112 is a metering blade 122, which is urged against the surface of donor roll 112 by a spring means such as 124 at a predetermined pressure. Because a relatively thick layer of toner is placed on the donor roll 112 by toner mover 120, the purpose of the metering blade 122 is to ensure that a smooth layer of this toner is presented ultimately to the development zone 114. A problem typical of single-component developer systems is that excess toner on the donor roll, which is desirable from the standpoint of insuring that there is enough toner on the roll, floods the pre-nip region just upstream of the metering blade 122 and thus increases the possibility of agglomerate formation. As mentioned above, the clogging under the metering blade 122 caused by the accumulation of toner agglomerates will cause streaks in the toner layer and eventually push the metering blade 122 away from the donor roll 112, thus causing the unwanted agglomerates to enter the development zone 114, with deleterious effects on copy quality. In order to permit relatively thick layers of toner on the donor roll, while avoiding the problem of accumulating agglomerates, the present invention provides a system whereby the donor roll 112 is caused by controlling motor 116 to rotate in a "reverse jog" of a half rotation or less, for the specific purpose of clearing out any accumulation of agglomerates under the metering blade 122. In one possibility, the reverse jog may occur after any given number of prints are made with the copier or printer, or after a certain number of rotations of the donor roll 112 are experienced, or after a fixed period of time in which the machine as a whole is operative; such a count of prints made or rotations of the donor roll or real time can be made by counting means, such as generally indicated as 117, associated with the controlling motor 16 and which may, for example, include a computer therein. Alternately, as shown in FIG. 1, the reverse jog may be initiated when a certain amount of pressure is sensed against the bottom of metering blade 122, which will have an effect on the spring means 124. This upward pressure may be detected by known means and can be used to "trigger" a reverse jog as necessary of the donor roll 112 by controlling motor 116. When this reverse jog occurs, as can be seen in FIG. 1, the accumulated toner under the metering blade 122 is essentially dumped back into the area around the toner mover 120.

Ideally, the toner layer on the surface of donor roll 112 just downstream of the metering blade 122 is of a uniform thickness, and also is of a uniform statistical distribution of sizes of toner particles. As mentioned above, one problem which has been experienced with single-component development systems is that areas along the length of the donor roll 112 which experience a relatively high turnover of toner particles tend to be statistically biased in favor of larger particles. With successive rotations of the donor roll 112, these high-turnover areas are statistically biased toward having large-sized toner particles, which tend to create darker than expected images on the photoreceptor and prints made therefrom.

To eliminate this phenomenon, known as "ghosting," there is provided downstream of the development zone 114 a rotating roll seal indicated as 126. The rotating roll seal comprises a rotating member, as shown, but the seal is preferably not in contact at all with the surface of the donor roll 112. The rotating roll seal 126 is electrically biased, as shown by sources 127, relative to the donor roll 112 to remove a significant portion of the remaining toner on the donor roll 112 after the development step. The DC bias on the roll seal provides the electrostatic attraction of the toner to the roll seal. This step effectively "erases" any "memory" of toner particle size distribution caused by the printing of a previous image. Thus, when the toner mover 120 replenishes the toner supply on the donor roll surface for the next cycle, there will be an even statistical distribution of all toner particle sizes along the entire length of the donor roll 112.

Workable biases of the roll seal referenced to the donor would be 50 to 400 volts with the preferred range 150 to 250 volts. For the spaced roll seal 126, an AC bias can be used to form a toner cloud to enable toner deposition onto the roll seal. The AC bias can be the same as that applied to the donor in the development nip. To mitigate the ghosting, at least 50% of the toner should be removed from the donor, so complete toner removal is not necessary for a satisfactory practical system. The roll seal 126 has a scraper 132 in contact with the surface thereof, so that toner is returned to the housing sump and the roll seal is renewed for repeated cycling. The roll seal 126 is preferably a rigid metal member for the noncontact configuration. A soft conformable seal made of skinned foam can, however, be run either in contact or out of contact with the donor roll 112.

The roll seal 126, being spaced from the surface of donor roll 112, has been shown to have the additional benefit of enabling air flow management into the interior of the developer unit, such as by an external source of air pressure or vacuum (not shown) to bring any airborne toner back into the interior of the unit through the gap as shown by arrow 128. A type of air pump, which may be independent or mechanically connected to other moving parts within the machine, is generally indicated as 130. As the AC jumping method of development is particularly prone to toner clouding, i.e., the presence of a fine mist of airborne toner particles circulating generally through the machine, and eventually contacting the final print sheets, this airborne control of toner particles will have a substantial and real effect on ultimate print quality.

In the present invention, it is intended that the combination of certain individual features together form a practical high-quality single-component development system which in particular avoids the twin problems of ghosting and streaking. The high quality of the images produced with the developer system of the present invention results from the action of these individual elements in concert. The toner mover 120 applies a relatively thick layer of toner onto the surface of donor roll 112; this thick layer is metered by metering blade 122; after the development step, a great deal of the leftover toner is removed by biased roll seal 126. In order to eliminate streaking, the donor roll 112 is, periodically or as needed, jogged in a reverse direction to clear the accumulation of toner under the metering blade 122. The roll seal 126 removes enough left over toner from the donor roll surface to erase any memory of previous images that have been developed, and in this way decreases the possibility of ghosting. Further, because the rotating roll seal 126 is preferably not in contact with the toner on the surface of donor roll 112, an air flow 128 may be introduced to draw in any airborne toner created in the jumping development step. This unique combination of elements thus facilitates a high-quality practical single-component development system.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

We claim:

1. An apparatus for developing a latent image, comprising:

a donor roll;

means for selectably rotating the donor roll in a process direction and in a reverse direction relative to the process direction;

a toner mover spaced from the donor roll, for loading toner particles onto a portion of the donor roll;

a metering blade disposed downstream of the toner mover in the process direction, adapted to regulate a quantity of toner on the donor roll;

a pressure sensor associated with the metering blade, adapted to detect the presence of a predetermined amount of toner between the metering blade and the donor roll; and a seal, spaced from the donor roll and disposed upstream of the toner mover in the process direction, adapted to remove at least approximately one half of the toner on the donor roll.

2. An apparatus for developing a latent image, comprising:

a donor roll;

means for selectably rotating the donor roll in a process direction and in a reverse direction relative to the process direction;

a toner mover spaced from the donor roll, for loading toner particles onto a portion of the donor roll;

a metering blade disposed along the donor roll downstream of the toner mover in the process direction, adapted to regulate a quantity of toner on the donor roll;

a controller associated with the rotating means to selectably rotate the donor roll in the reverse direction for less than an entire revolution following rotation of the donor roll in the process direction;

a pressure sensor associated with the metering blade, adapted to detect the presence of a predetermined amount of toner between the metering blade and the donor roll; wherein the controller is responsive to the pressure sensor and adapted to cause rotation in the reverse direction in response to a predetermined amount of pressure being detected on the metering blade; and a seal, spaced from the donor roll and disposed upstream of the toner mover in the process direction, adapted to remove at least approximately one half of the toner on the donor roll.

3. An electrophotographic printing apparatus, including a developer unit for developing a latent image, the developer unit comprising:

a donor roll;

means for selectably rotating the donor roll in a process direction and in a reverse direction relative to the process direction;

a toner mover spaced from the donor roll, for loading toner particles onto a portion of the donor roll;

a metering blade disposed downstream of the toner mover in the process direction, adapted to regulate a quantity of toner on the donor roll;

a pressure sensor associated with the metering blade, adapted to detect the presence of a predetermined amount of toner between the metering blade and the donor roll; and a seal, spaced from the donor roll and disposed upstream of the toner mover in the process direction, adapted to remove at least approximately on half of the toner on the donor roll.

4. An electrophotographic printing apparatus, including a developer unit for developing a latent image, the developer unit comprising:

a donor roll;

means for selectably rotating the donor roll in a process direction and in a reverse direction relative to the process direction;

a controller associated with the rotating means to rotate the donor roll in the reverse direction for less than an entire revolution following rotation of the donor roll in the process direction;

a toner mover spaced from the donor roll, for loading toner particles onto a portion of the donor roll;

a metering blade disposed downstream of the toner mover in the process direction, adapted to regulate a quantity of toner on the donor roll; and a pressure sensor associated with the metering blade, adapted to detect the presence of a predetermined amount of toner between the metering blade and the donor roll, wherein the controller is responsive to the pressure sensor and adapted to cause rotation in the reverse direction in response to a predetermined amount of pressure being detected on the metering blade.

* * * * *